US005464163A

United States Patent [19]

Zoz

[11] Patent Number: 5,464,163

[45] Date of Patent: Nov. 7, 1995

[54] ATTRITOR

[75] Inventor: Henning Zoz, Kreuztal, Germany

[73] Assignee: ZOZ Maschinenbau GmbH, Krueztal, Germany

[21] Appl. No.: 207,925

[22] Filed: Mar. 7, 1994

[30] Foreign Application Priority Data

Mar. 6, 1993 [DE] Germany ..... 43 07 083.3

[51] Int. Cl.[6] ..... B02C 17/16

[52] U.S. Cl. ..... 241/172; 241/65; 241/174; 241/179; 241/285.2

[58] Field of Search ..... 241/172, 173, 241/174, 179, 285.2, 100, 65; 277/81 R

[56] References Cited

U.S. PATENT DOCUMENTS

| | | | |
|---|---|---|---|
| 2,736,579 | 2/1956 | Dickinson | 277/81 R |
| 4,273,295 | 6/1981 | Pollmann | 241/46.11 |
| 4,634,134 | 1/1987 | Entrikin | 277/12 |
| 5,193,754 | 3/1993 | Pujol | 241/65 |
| 5,333,804 | 8/1994 | Liebert | 241/69 |
| 5,346,145 | 9/1994 | Kamiwano et al. | 241/172 |

*Primary Examiner*—Timothy V. Eley
*Assistant Examiner*—John M. Husar
*Attorney, Agent, or Firm*—Herbert Dubno

[57] ABSTRACT

An attritor has one end of the milling chamber defined by a wall from which a bearing and seal housing is cantilevered, the wall having a flange onto which the milling vessel can be replaceably and interchangeably attached. The milling vessel and housing have a horizontal axis and a rotor rotatable about this axis in the housing as agitator elements for the loose milling medium therein.

16 Claims, 6 Drawing Sheets

9a
12a
8a
8b
12b
9b
11

12b
9b
8b
9a
12a
8a
12c
8c
11
9c 11
12b
12a

ATTRITOR

FIELD OF THE INVENTION

My present invention relates to an attritor and, more particularly, to a mill for the finest milling of solids and serving as an attritor. An attritor of this type can comprise a milling vessel enclosing a milling chamber and containing a loose filling of milling bodies. Rotatable relative to this housing can be a shaft driving a rotor within the vessel formed with agitator elements for inducing an intensive movement of the milling bodies within the filling and journaled relative to the chamber in a bearing assembly provided with a shaft seal.

BACKGROUND OF THE INVENTION

Attritors of the aforedescribed type referred to generally as attrition mills, are widely used for the finest milling of solids. They are particularly suitable for the comminution of hard materials like Ti—Co, VC—Co, WC—Co, SiC—steel and the finest milling of more complex hard materials like Ti—WC—Co, Ta—WC—Co, TiC—WC—Co and the like.

Preferably the attritor is utilized for the production of extremely fine powders of permanent magnet materials like Nd—Fe—B and the production of other mechanical alloys. These and similar hard materials are generally comminuted into powders in the nanometer particle size range with especially sensitive materials being handled under vacuum or a protective gas.

Attritors of the aforedescribed type generally have an upright configuration whereby the milling vessel and the rotor have a common vertical axis. With this type of conventional construction there is only a limited transfer of energy between the rotor and the milling body filling, especially with dry milling. Because of the limited energy transfer, the vessel cannot be made particularly compact and the milling apparatus is generally quite bulky.

OBJECTS OF THE INVENTION

It is the principal object of the present invention to provide an attritor for the finest milling of solids of the aforedescribed type which is free from the disadvantages of prior attritors.

Another object of the invention is to provide an attritor of the overall construction described wherein there is an improved journaling and sealing of the shaft so that dry milling can be carried out more efficiently.

It is also an object of this invention to provide an improved attritor which affords greater energy efficiency and, in particular, allows greater transfer of energy from the shaft and rotor to the milling bodies of the filling.

Still another object of the invention is to provide a shaft and steel assembly for an attritor of the aforedescribed type which is of simple construction and allows a horizontal orientation of the axis and greater energy transfer to the milling bodies.

SUMMARY OF THE INVENTION

These objects and others which will become apparent hereinafter are attained in an attritor with a horizontal axis as described, with the improved bearing and sealing unit of the present invention as will be described in greater detail below and which enables milling vessels to be interchangeably mounted on that unit for replacement of one vessel by another of a different shape, size or material.

More particularly, the attritor of the invention can comprise:

a milling vessel forming a milling chamber having a horizontal axis and adapted to receive a loose filling of milling bodies;

a bearing-and-seal unit formed with a wall defining an endwall of the chamber, centered on the axis and provided with a shaft seal and a journal bearing, the bearing-and-seal unit having means enabling a number of different milling vessels to be juxtaposed with the bearing-and-seal unit;

a shaft rotatable about the axis, sealed relative to the milling vessel by the shaft seal and journaled for rotation in the journal bearing; and a rotor connected to the shaft, disposed in the milling vessel and formed with agitator elements imparting intensive movement to the bodies of the filling upon rotation of the shaft.

Thus the bearing-and-shaft steel unit of the invention forms directly a front-end wall of the milling chamber and constitutes a unit which enables the different milling vessels to be affixed to this wall.

A high level of energy transfer is effected between the rotor on which the agitator elements are mounted and the filling of the milling body to a point just below the critical movement of the milling body. The "critical movement" of the milling bodies is understood to be the state in which the milling bodies rather than moving randomly and independently of one another, move collectively under the effect of centrifugal forces and relative movement between these milling bodies practically ceases.

With the construction of the invention, there is the significant advantage that a milling vessel can be removed from the drive unit and the rotor in a simple manner and easily replaced with another milling vessel. It should be understood that different materials to be milled are not always milled most efficiently in the same vessel and in many cases it may be advantageous to clean out one vessel while another is substituted for it on the unit to continue the milling process. With simply replaceable and interchangeable vessels which may be composed of different materials or can be linings of different materials, e.g. soft linings as, for example, Linatex (natural rubber) or hard linings like silicon carbide, steel or the like the down times and high costs associated with the cleaning can be avoided.

Preferably the end wall is provided with a connecting flange for the differently configured milling vessels to be interchangeably mounted thereon.

According to a feature of the invention, a cylindrical bearing housing extends downwardly from this end wall and surrounds the rotor shaft, containing axially spaced ball bearings or other roller bearings to journal the shaft in this housing.

A highly efficient shaft seal can also be provided in this housing when, preferably between the wall and the bearing closest to the wall, the units of the shaft seal are disposed in succession.

According to a feature of the invention, the bearing-and-seal unit can further comprise:

an adjustable force resilient axial spreader between the rolling bearings, one of the rolling bearings being proximal to the wall, the other of the rolling bearings being remote from the wall, the shaft being axially slidable in the one of the rolling bearings, the spreader being braced against the other of the rolling bearings and urging same away from the chamber;

a threaded coupling member on the shaft and engaging the other of the rolling bearings whereby the spreader draws the rotor toward the wall; and a slide-ring seal on the housing pressed by the rotor against the wall by a force generated by the spreader.

The spreader is preferably formed as a spring, e.g. a stack of spring washers, i.e. Belleville washers.

The seal can comprise, in succession, from the chamber toward the rolling bearing proximal to the wall, the following sealing elements:

an axial slide ring or slip ring seal;

a radial labyrinth sealing ring which can be composed of polytetrafluoroethylene;

a radial expansion chamber having an outlet passage opening toward an exterior of the housing;

a V-section sealing ring rotatable with the shaft and formed with a pliably elastic radial sealing lip;

an annular disk fixed in the housing and cooperating with the V-section sealing ring; and a double-lip radial ring seal fixed in the housing or a thrust bearing bridging the shaft and the housing.

The thrust bearing referred to here is a high wear-resistant or high-strength seal traversed by the shaft.

According to another feature of the invention, the rotor carries a centrifugally displaceable disk, concave toward the rotor and juxtaposed with a slide ring seal threaded into the wall and supporting the precompressed polytetrafluoroethylene (PTFE) sealing ring forming a labyrinth seal around the shaft.

The vessel in an axial section can have a configuration of two identical but oppositely oriented rhomboids with common bases coinciding with the axis. The chamber can, moreover, be defined between two inwardly concave end walls and an inwardly concave peripheral wall symmetrical about the axis. Alternatively, the vessel can have the configuration of a cylinder centered on the axis and two inwardly concave end walls or two inwardly planar end walls perpendicular to the axis.

It has been found advantageous in most cases to provide a double wall cooling jacket surrounding the chamber.

The agitator elements can each be formed with at least two angularly equispaced arms with the agitator elements being angularly offset from one another. Where two arms are provided, they are spaced 180° apart and when three arms are provided, they are offset by 120° from one another.

Each of the agitator elements can have a disk-shape with straight radial leading edges and rearwardly curved trailing edges or the agitator elements can be rocking or mutating disks.

It has been found to be advantageous, moreover, to provide the vessel so that at least its internal walls are composed of a ceramic material, the agitator elements of a ceramic material and a replaceable ceramic disk as a lining on the end wall facing into the chamber.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
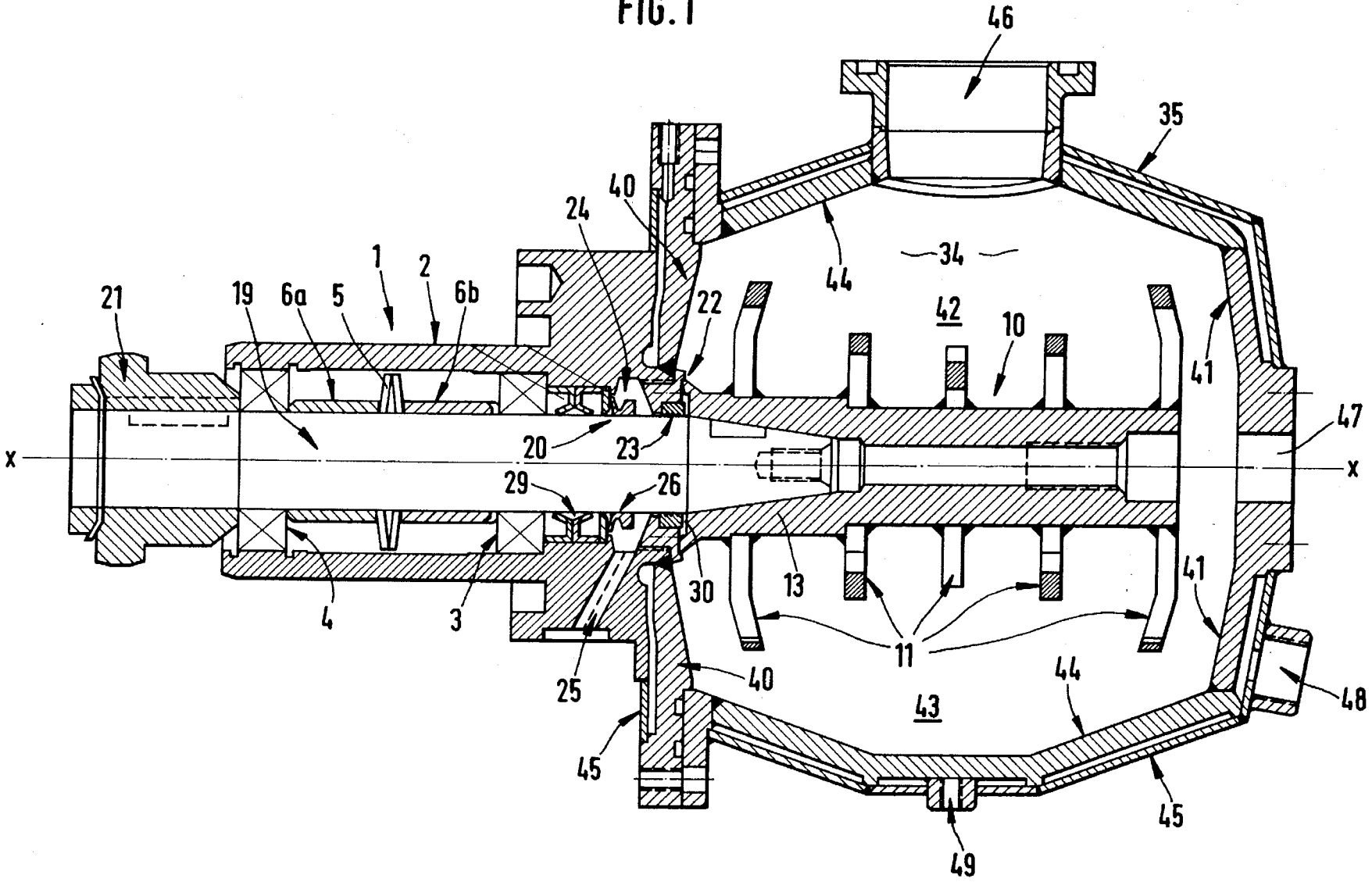
FIG. 1 is an axial cross sectional view of an attritor according to the invention wherein the milling vessel which is interchangeably mounted on the bearing-and-seal unit has the rhomboidal cross section described above.

The attritors shown in FIGS. 1–3 and 6 all comprise a milling vessel 35 or 36 (FIG. 2) or 37 (FIG. 3) defining a milling chamber 34 receiving a loose filling of milling bodies and used for the finest milling of solids. The milling bodies, being elements utilized with the apparatus, have not been illustrated so as not to obscure structures within the interior of the vessel.

Generally these bodies are ball-shaped or spherical with a particle size up to 10 mm and composed of a wear-resistant hard material like a ceramic or tungsten carbide. The filling occupies up to 50% of the volume of the milling chamber.

Within the interior of the vessel 35, 36 or 37 extends a rotor 10 rotatable about a horizontal axis x—x which coincides with the axis of the vessel.

To induce an intensive movement of the milling bodies within the filling in the vessel, the rotor 10 is equipped with agitator elements 11. The rotor 10 also comprises a rotor body 13 which is releasably connected with a conical seat and a screw thread 16 with the rotor shaft 19. A key 17 rotationally couples the shaft 19 to the rotor body 13, the key being provided in appropriate key slots or grooves as is conventional in the use of keys for rotationally coupling.

Because of the horizontal arrangement of the rotor 10 and the shaft 19 with respect to the milling chamber 17, an especially trouble-free seal of the shaft with its bearing with its bearing 1 in a bearing housing 2 is required.

According to the invention, the journal bearing 1 and the shaft seal 20 are integrated with the end wall 40 of the chamber 34 into a unit with which different milling vessels 35 or 36 or 37 can be juxtaposed and connected. In this manner, therefore, the end wall 40 can be selectively connected to any of a number or replaceable and interchangeable milling vessels 35–37.

The invention also provides the advantage of a mechanical separation between the milling vessel 35, 36 or 37 and the unit formed by the rotor shaft 19, the rotor 10, the shaft seal 20 and the end wall 40, thereby facilitating maintenance, replacement and monitoring of the wear of the parts.

As FIGS. 1–3 and 6 indicate, the cylindrical bearing housing 2 extends outwardly from the end wall 40 and is cantilevered therefrom, receiving a pair of axially-spaced rolling bearings 3 or 4 forming the journal bearing 1.

The rotor shaft 19 is axially slidable in the rolling bearing 3 which is relatively proximal to the end wall 40 and has a coupling member 21 or nut threaded onto an end of the shaft and braced against the distal rolling bearing 4. A key 17*a* can be provided between the nut 21 and the shaft 19 to prevent unscrewing of the nut 21.

Between the rolling bearing 3 and 4 is an axial spreader 5 with adjustable spreading force. This spring-loaded spreader causes the rotor 10 to bear with its body 13 against an axial slide ring seal 22, pressing it against the end wall 40.

The rolling bearing 4 can have its outer race axially slidable in a seat within the housing 2.

The spring member of the spreader 5 can be a stack of spring washers, i.e. the Belleville washers 5, braced against spacers 6*a* and 6*b* of the spreader which bear, in turn, upon the inner races of the bearings 3 and 4.

It will also be apparent from FIGS. 1–3 and 6 that the application of the spring force by the spreader element gives rise to a reaction force which presses the rolling bearing 3 against a shoulder 31 of the bearing housing 2 via the spacer 6*b*. The bearings should be bearings capable of allowing axial force transmission, such as inclined roller bearings or high-shoulder ball bearings, i.e. thrust bearings or combined thrust and radial bearings.

Figure 2:
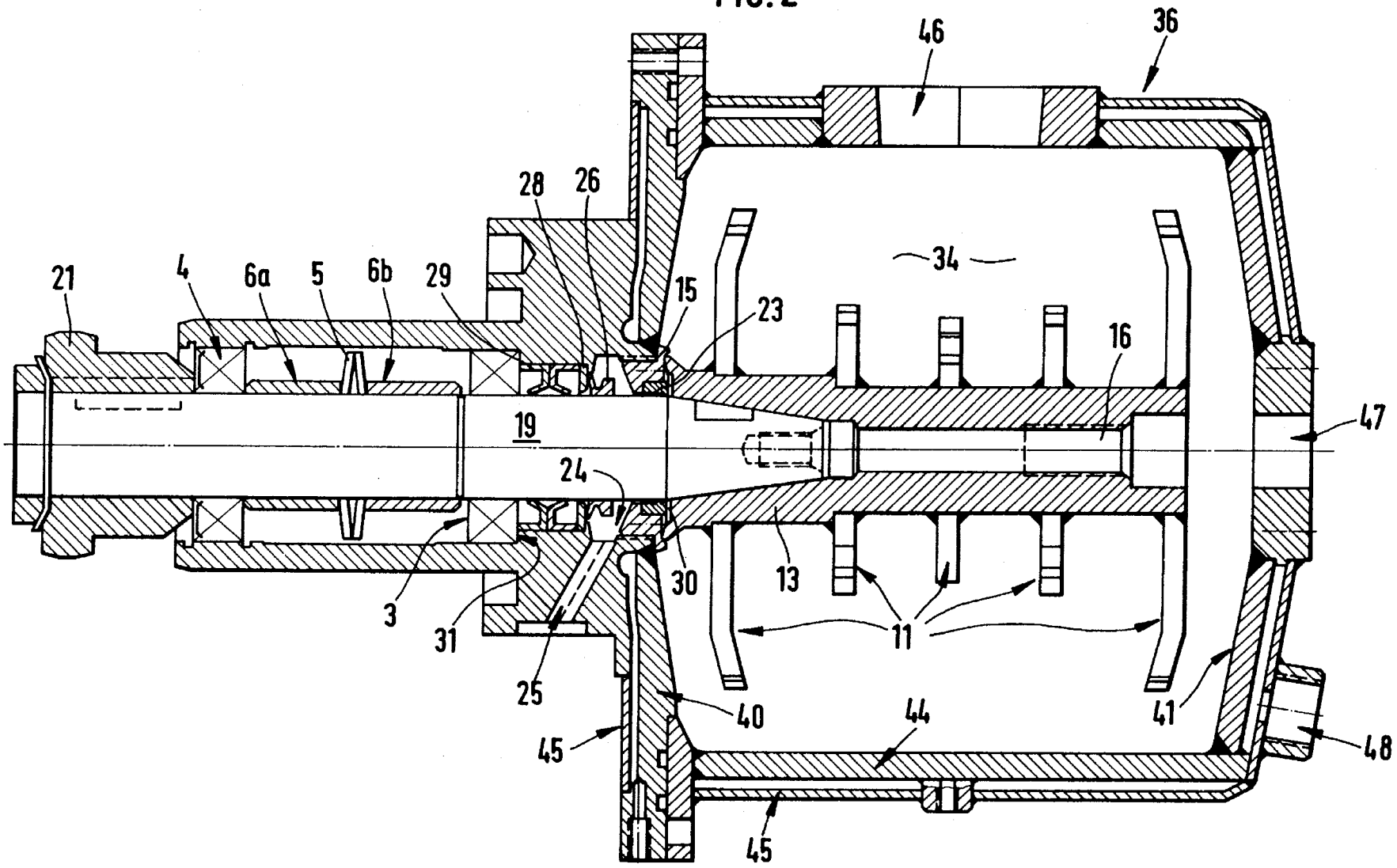
FIG. 2 is a similar axial cross sectional view wherein the vessel has a cylindrical peripheral wall but inwardly concave end walls.
Figure 3:
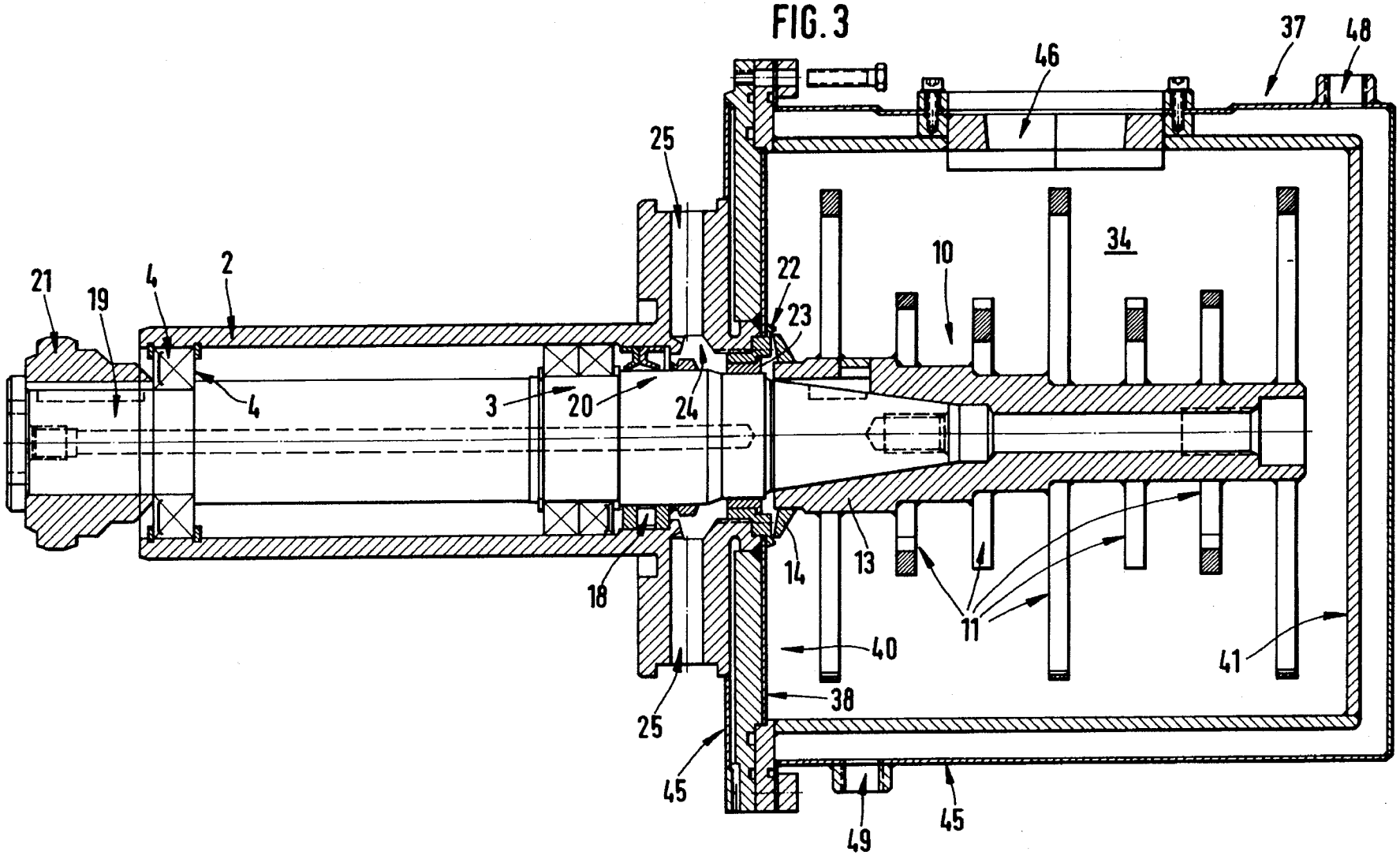
FIG. 3 is an axial cross sectional view through an attritor according to the invention wherein the vessel has planar end walls and a cylindrical peripheral wall.
Figure 4A:
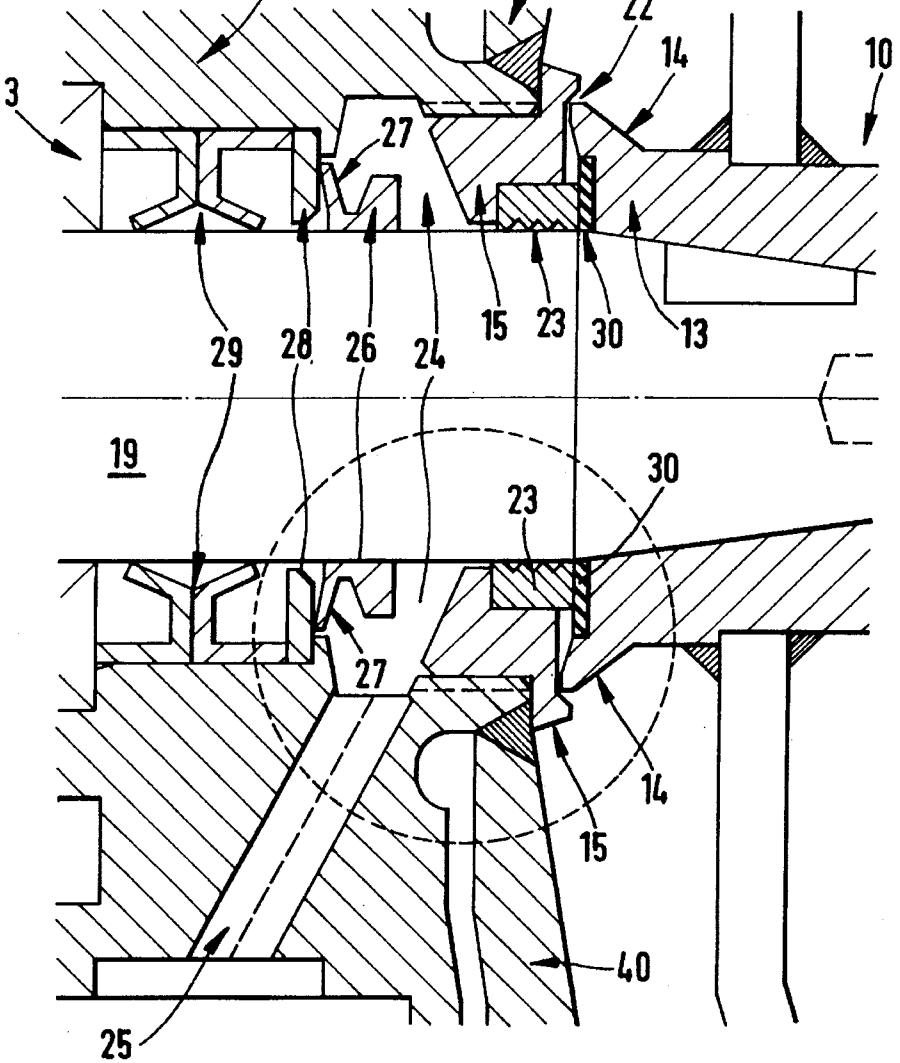
FIG. 4*a* is a section representing a detail of FIG. 1 in the shaft seal region.
Figure 4B:
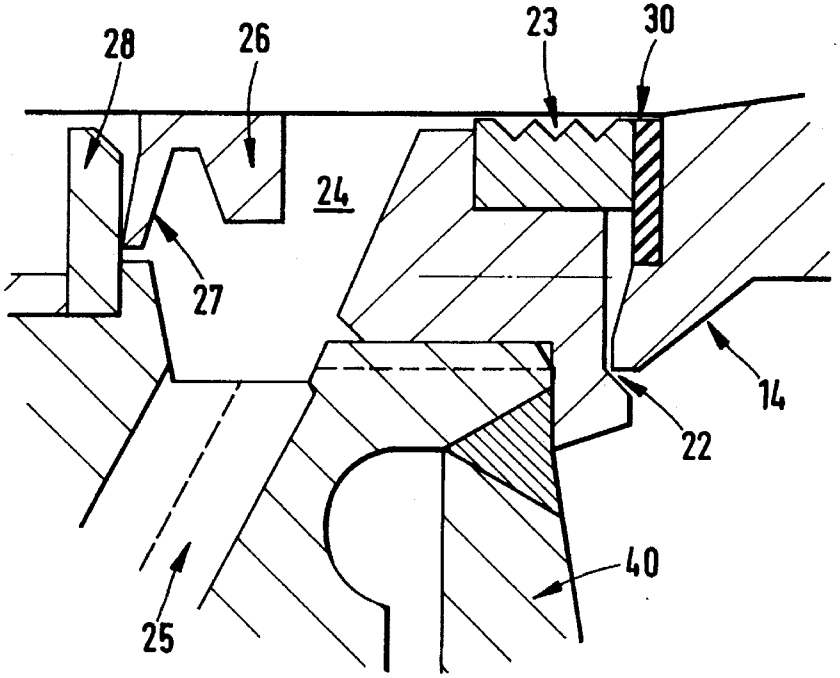
FIG. 4*b* is a detail drawn to a greater scale of the region IVb of FIG. 4*a;*

As can be seen from FIGS. 1–3 and 6 but is shown in greater detail in FIGS. 4*a* and 4*b*, the shaft seal comprises the following cooperating sealing elements disposed between the milling chamber 34 and the first rolling bearing 3, in order:

an axial slide or slip ring seal 22, a radial PTFE labyrinth sealing ring 23, a radial pressure relief compartment 24 with vent passage 25, a V-section sealing ring 26 serving with the shaft 19 and having a soft elastic radial sealing lip 27, an annular disk 28 fixed in bearing housing 2 and cooperating with the sealing lip, and a double-lip radial ring seal 29 fixed in the bearing housing 2 or a high wear-resistant rotary member 18 (FIG. 3) or thrust bearing fulfilling the same function.

The axial slide or slip ring seal 22 can be juxtaposed with a centrifugal disk 14 which is concave in the direction of that slide ring seal and which is threaded into the end wall 40 to form a holder for retaining under precompression a PTFE sealing ring 23 forming the labyrinth sealing. The portion of the slide ring bearing on the face of the end wall 40 has been represented at 15 in FIG. 2.

The entire sealing arrangement 20 is significantly less complicated than may appear at first blush. All sealing elements are commercial in nature and can be mounted without significant difficulty. Dust particles which manage to pass the slide ring seal 22 and the labyrinth sealing ring can be collected in the venting chamber 24 and can be pulled out through the passage 25 without reaching the further sealing elements 26–29. The sealing elements together, therefore, are not complicated and provide an absolutely reliable seal.

Furthermore, between the centrifugal disk 14 and the labyrinth seal 23 a further elastic gap seal 30 can be provided which can be composed of ceramic/PTFE or hardened steel/PTFE and, for example, can include a ceramic disk or a disk of hardened steel (FIG. 4*b*).

From FIG. 1 it will be apparent that the milling vessel 35 has a cross section of two opposing rhomboids 42 and 43 whose bases coincide with the axis x—x and thus that the peripheral wall 44 is rotationally symmetrical. The two end walls 40 and 41 are concave inwardly.

The result is a double-conical configuration of the milling vessel and, in combination with the axial staggering of the agitator element 11 and the staggering in lengths of the arms thereof (FIG. 1) causes the milling balls to flow in a toroidal path. In the region of the two end walls 40 and 41, the milling balls are lifted especially strongly and tend to cascade inwardly toward the center below the inlet and outlet opening 46 in opposing cascades. The milling balls accumulating at the center are driven outwardly toward the ends and upwardly. This vessel configuration is especially effective for milling products which have a tendency to bake onto the walls, to adhere by magnitization or Van Der Waal's forces. Metal with ferromagnetic characteristics can be milled and the attritor can be utilized also to mill for the finest milling of permanent magnet materials.

The milling vessel has, in addition to its inlet and outlet opening 46, also a venting opening 47 and in the case that a cooling jacket is provided, water connections 48 and 49 for water intake and discharge.

In FIGS. 2 and 3, other milling vessels 36 and 37 are illustrated which can be easily dismounted and replaced by the same end wall 40 as described and the drive including the shaft 19 which can be rotated by an electric motor (not shown).

FIG. 2 uses a milling vessel 36 with a cylindrical peripheral wall 44 centered on the axis. 1 The end walls 40 and 41 are concave inwardly. This milling vessel can be fabricated very economically and is satisfactory for less complicated milling processes.

A still simpler configuration of the milling vessel is represented at 37 in FIG. 3 where the end walls 40 and 41 are planar and perpendicular to the axis x—x. The peripheral wall is comparatively thin. In this embodiment the bearing assembly can also be simplified. For example, the spreading member 5 can be omitted and the rolling bearings 3 and 4 axially fixed with only the expansion play in the double bearing 3 compensated between the outer ring and the bearing seat.

The expansion chamber 24 is connected to upwardly and downwardly open passages 25 and a blocking medium can be positioned through the chamber 24 via these passages as desired to carry off particles which may pass the slide ring seal 22 and the labyrinth seal 23 after these particles have entered the chamber 24 but serves the seals lying further to the rear. This embodiment is simpler than the embodiments previously described and has been found to be especially effective for very hard but sensitive products to be milled.

All of the embodiments 35–37 of the milling vessel have cooling jackets 45. Of course, the double wall jacket can be used for a heating medium if desired, for example an oil, if the milling chamber is to be heated.

Figures 5A, 5B, 5C:
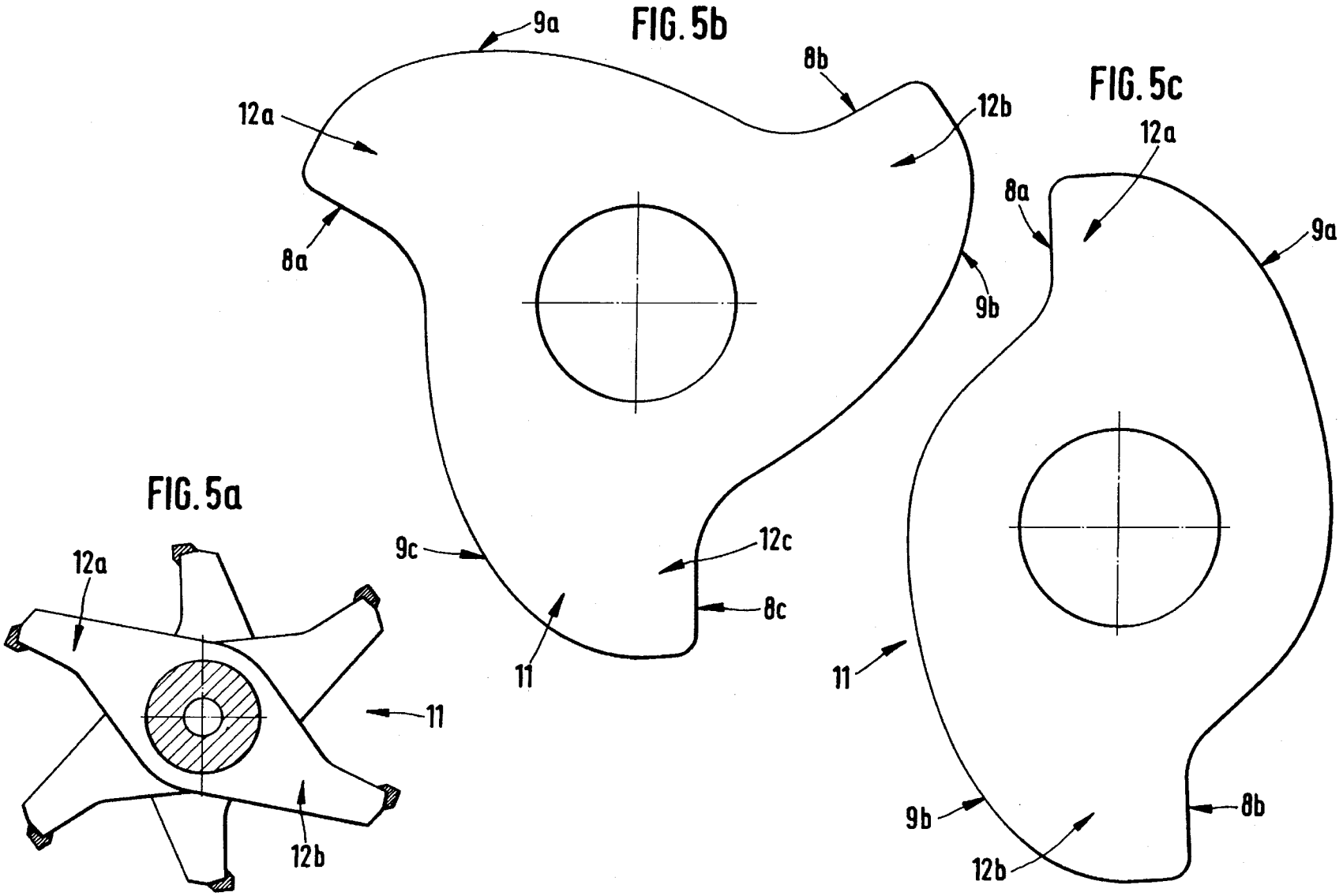
FIG. 5*a* is a cross sectional view through the rotor showing the agitator elements in elevation.
FIG. 5*b* is an enlarged elevational view of an agitator element which can be substituted for the agitator elements of FIG. 5*a;*
FIG. 5*c* is an elevational view of another agitator element.

FIGS. 5*a*–5*c* show several examples of agitator elements 11. As indicated in FIG. 5*a* these can be provided with two arms 12*a*, 12*b* at 180° to one another or, as can be seen in FIG. 5*b*, three arms 12*a*, 12*b* and 12*c* can be provided at 120° to one another.

As is apparent from FIG. 5*a*, the elements are angularly offset from one another on the rotor body. They can be composed of hard metal or ceramic and can be of different thicknesses.

As shown in FIG. 5*a*, the ends of the arms can be provided with hardened tips 11*a*. Preferably the agitator elements 11 are disk-shaped with straight radial leading edges 8*a*, 8*b*, 8*c* and rearwardly-curved rear edges 9*a*, 9*b*, 9*c*.

Figure 6:
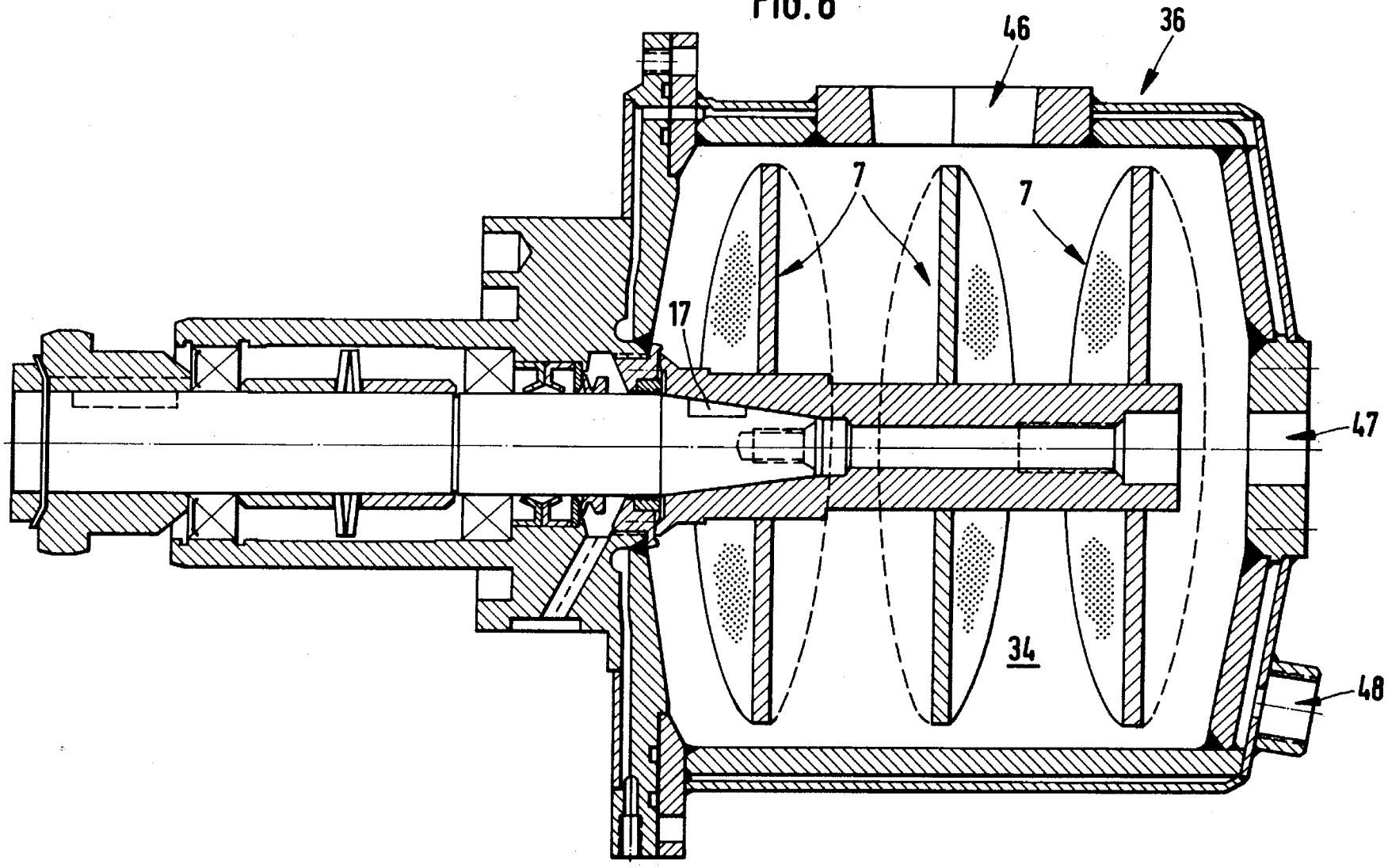
FIG. 6 is an axial cross sectional view of an attritor with agitator elements formed as rocking disks.

FIG. 6 shows an attritor with milling vessel 36 in which the agitator elements 7 are locking disks which rock back and forth or are positioned to mutate on the rotor. These rocking disks can generate a multiplicity of turbulent flow zones and ensure an especially intensive mixing of the balls. Wear of the agitator elements is also reduced in this embodiment. This system has been found to be especially economical for many milling purposes.

The attritor of the invention thus allows the highest possible milling efficiency to be achieved in an economical manner.

I claim:

1. An attrition mill, comprising:

a stationary milling vessel forming a milling chamber having a horizontal axis and adapted to receive a loose filling of milling bodies;

a bearing-and-seal unit formed with a wall defining an endwall of said chamber, centered on said axis and provided with a shaft seal and a journal bearing, said bearing-and-seal unit having means enabling a number of different milling vessels to be juxtaposed with said bearing-and-seal unit;

a horizontal shaft rotatable about said axis, sealed relative to said milling vessel by said shaft seal and journaled for rotation in said journal bearing; and a rotor connected to said shaft, disposed in said milling vessel and formed with agitator elements transverse to the axis imparting intensive movement to the bodies of said filling upon rotation of said shaft, said wall of said bearing-and-seal unit being formed with a connecting flange connectable with respective flanges of differently shaped interchangeable milling vessels, a bearing housing cantilevered on said wall of said bearing-and-seal unit, being coaxial with said shaft and extends from said wall away from said chamber, said housing surrounding said shaft and receiving said journal bearing, said journal bearing including two axially spaced rolling bearings journaling said shaft in said housing.

2. The attrition mill defined in claim 1 wherein said rotor carries a centrifugally displaceable disk concave toward said rotor and juxtaposed with a slide-ring seal threaded into said wall and supporting a precompressed polytetrafluoroethylene sealing ring forming a labyrinth seal around said shaft.

3. The attrition mill defined in claim 1 wherein said vessel in an axial section has a configuration of two identical but oppositely oriented rhomboids with common bases coinciding with the axis.

4. The attrition mill defined in claim 1 wherein said chamber has two inwardly concave endwalls symmetrical about said axis, and an inwardly concave rotationally symmetrical peripheral wall.

5. The attrition mill defined in claim 1 wherein said vessel has a configuration of a cylinder centered on said axis and two inwardly concave endwalls.

6. The attrition mill defined in claim 1 wherein said vessel has a configuration of a cylinder centered on said axis and two inwardly planar endwalls perpendicular to said axis.

7. The attrition mill defined in claim 1, further comprising a double-wall cooling jacket surrounding said chamber.

8. The attrition mill defined in claim 1 wherein said agitator elements are each formed with at least two angularly equispaced arms, and the arms of successive agitator elements along the rotor are angularly offset from one another.

9. The attrition mill defined in claim 8 wherein two arms offset by 180° are provided on each of said agitator elements.

10. The attrition mill defined in claim 8 wherein three arms offset by 120° are provided on each of said agitator elements.

11. The attrition mill defined in claim 1 wherein each of said agitator elements has a disk shape with straight radial leading edges and rearwardly curved trailing edges.

12. The attrition mill defined in claim 1 wherein the agitator elements are rocking disks.

13. The attrition mill defined in claim 1 wherein said vessel is composed of a ceramic material, said agitator elements are composed of a ceramic material, and a replaceable ceramic disk is provided as a lining on said endwall facing said chamber.

14. An attrition mill, comprising:

a milling vessel forming a milling chamber having a horizontal axis and adapted to receive a loose filling of milling bodies;

a bearing-and-seal unit formed with a wall defining an endwall of said chamber, centered on said axis and provided with a shaft seal and a journal bearing, said bearing-and-seal unit having means enabling a number of different milling vessels to be juxtaposed with said bearing-and-seal unit;

a shaft rotatable about said axis, sealed relative to said milling vessel by said shaft seal and journaled for rotation in said journal bearing; and a rotor connected to said shaft, disposed in said milling vessel and formed with agitator elements imparting intensive movement to the bodies of said filling upon rotation of said shaft, said wall of said bearing-and-seal unit being formed with a connecting flange connectable with respective flanges of differently shaped interchangeable milling vessels, a bearing housing cantilevered on said wall of said bearing-and-seal unit, being coaxial with said shaft and extends from said wall away from said chamber, said housing surrounding said shaft and receiving said journal bearing, said journal bearing including two axially spaced rolling bearings journaling said shaft in said housing said bearing-and-seal unit further comprising:

an adjustable force resilient axial spreader between said rolling bearings, one of said rolling bearings being proximal to said wall, the other of said rolling bearings being remote from said wall, said shaft being axially slidable in said one of said rolling bearings, said spreader being braced against said other of said rolling bearings and urging same away from said chamber;

a threaded coupling member on said shaft and engaging said other of said rolling bearings whereby said spreader draws said rotor toward said wall; and a slide-ring seal on said housing pressed by said rotor against said wall by a force generated by said spreader.

15. The attrition mill defined in claim 14 wherein said spreader includes a spring in the form of a compressible stack of Belleville washers.

16. An attrition mill, comprising:

a milling vessel forming a milling chamber having a horizontal axis and adapted to receive a loose filling of milling bodies;

a bearing-and-seal unit formed with a wall defining an endwall of said chamber, centered on said axis and provided with a shaft seal and a journal bearing, said bearing-and-seal unit having means enabling a number of different milling vessels to be juxtaposed with said bearing-and-seal unit;

a shaft rotatable about said axis, sealed relative to said milling vessel by said shaft seal and journaled for rotation in said journal bearing; and a rotor connected to said shaft, disposed in said milling vessel and formed with agitator elements imparting intensive movement to the bodies of said filling upon rotation of said shaft, said wall of said bearing-and-seal unit being formed with a connecting flange connectable with respective flanges of differently shaped interchangeable milling vessels, a bearing housing cantilevered on said wall of said bearing-and-seal unit, being coaxial with said shaft and extends from said wall away from said chamber, said housing surrounding said shaft and receiving said journal bearing, said journal bearing including two axially spaced rolling bearings journaling said shaft in said housing comprising, in succession from said chamber toward said other rolling bearing:

an axial slide ring or slip ring seal;

a radial labyrinth sealing ring which can be composed of polytetrafluoroethylene;

a radial expansion chamber having an outlet passage opening toward an exterior of said housing;

a V-section sealing ring rotatable with said shaft and formed with a pliably elastic radial sealing lip;

an annular disk fixed in said housing and cooperating with said V-section sealing ring; and a double-lip radial ring seal fixed in said housing or a thrust bearing bridging said shaft and said housing.

* * * * *